US009599385B2

(12) United States Patent
Guarino et al.

(10) Patent No.: US 9,599,385 B2
(45) Date of Patent: Mar. 21, 2017

(54) WEIRLESS ICE TRAY

(71) Applicant: Whirlpool Corporation, Benton Harbor, MI (US)

(72) Inventors: James C.L. Guarino, Kalamazoo, MI (US); Lindsey Ann Wohlgamuth, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 707 days.

(21) Appl. No.: 13/713,271

(22) Filed: Dec. 13, 2012

(65) Prior Publication Data

US 2014/0165623 A1 Jun. 19, 2014

(51) Int. Cl.

| | |
|---|---|
| ***F25C 5/06*** | (2006.01) |
| ***F25C 1/04*** | (2006.01) |
| ***F25C 1/22*** | (2006.01) |
| ***F25C 1/24*** | (2006.01) |
| ***F25C 5/18*** | (2006.01) |

(52) U.S. Cl.

CPC ..... *F25C 1/04* (2013.01); *F25C 1/225* (2013.01); *F25C 1/24* (2013.01); *F25C 5/182* (2013.01)

(58) Field of Classification Search

CPC .... F25C 1/00; F25C 5/005; F25C 1/04; F25C 1/225; F25C 2400/10

USPC ..... 62/66, 72, 340, 344

See application file for complete search history.

(56) References Cited

U.S. PATENT DOCUMENTS

| | | | |
|---|---|---|---|
| 1,407,614 | A | 2/1922 | Wicks |
| 2,244,081 | A | 6/1941 | Reeves |
| 2,481,525 | A | 9/1949 | Mott |
| 2,617,269 | A | 11/1952 | Smith-Johannsen |
| 2,757,519 | A | 8/1956 | Sampson |
| 2,846,854 | A | 8/1958 | Galin |
| 2,878,659 | A | 3/1959 | Prance et al. |
| 2,969,654 | A | 1/1961 | Harle |
| 3,009,336 | A | 11/1961 | Bayston et al. |
| 3,016,719 | A | 1/1962 | Reindl |
| 3,033,008 | A | 5/1962 | Davis |
| 3,046,753 | A | 7/1962 | Carapico, Jr. |
| 3,075,360 | A | 1/1963 | Elfving et al. |
| 3,084,678 | A | 4/1963 | Lindsay |
| 3,144,755 | A | 8/1964 | Kattis |
| 3,192,726 | A | 7/1965 | Newton |
| 3,217,511 | A | 11/1965 | Keighley |

(Continued)

FOREIGN PATENT DOCUMENTS

| | | | |
|---|---|---|---|
| CN | 102353193 | A | 2/2012 |
| EP | 1821051 | A1 | 8/2007 |
| JP | 3158670 | A | 7/1991 |
| JP | 3158673 | A | 7/1991 |
| JP | 5001870 | A | 1/1993 |
| JP | 5332562 | A | 12/1993 |
| JP | 6003005 | A | 1/1994 |
| JP | 06011219 | A | 1/1994 |
| JP | 10227547 | A | 8/1998 |
| JP | 11223434 | A | 8/1999 |

(Continued)

OTHER PUBLICATIONS

European Searching Authority, European Search Report and Opinion for Application No. EP 13194682.4, Jul. 15, 2015, 12 pages.

(Continued)

*Primary Examiner* — Melvin Jones

(57) ABSTRACT

An ice tray may include a substantially planar body portion with a plurality of cavities that are not interconnected by weirs. The ice tray may include a body having raised portions between adjacent cavities to alleviate stress that may otherwise form in these areas. A water distribution system may be utilized to provide specified volumes of water in the cavities to prevent overflowing of the cavities.

20 Claims, 4 Drawing Sheets

(56) References Cited

U.S. PATENT DOCUMENTS

| | | | | |
|---|---|---|---|---|
| 3,308,631 | A * | 3/1967 | Kniffin | 62/137 |
| 3,318,105 | A | 5/1967 | Burroughs et al. | |
| 3,321,932 | A | 5/1967 | Orphey, Jr. | |
| 3,383,876 | A | 5/1968 | Frohbieter | |
| 3,775,992 | A | 12/1973 | Bright | |
| 3,806,077 | A | 4/1974 | Pietrzak et al. | |
| 3,864,933 | A | 2/1975 | Bright | |
| 3,892,105 | A | 7/1975 | Bernard | |
| 3,952,539 | A | 4/1976 | Hanson et al. | |
| 4,006,605 | A | 2/1977 | Dickson et al. | |
| 4,059,970 | A | 11/1977 | Loeb | |
| 4,062,201 | A | 12/1977 | Schumacher et al. | |
| 4,078,450 | A | 3/1978 | Vallejos | |
| 4,184,339 | A | 1/1980 | Wessa | |
| 4,222,547 | A | 9/1980 | Lalonde | |
| 4,261,182 | A | 4/1981 | Elliott | |
| 4,462,345 | A | 7/1984 | Routery | |
| 4,483,153 | A | 11/1984 | Wallace | |
| 4,587,810 | A | 5/1986 | Fletcher | |
| 4,685,304 | A | 8/1987 | Essig | |
| 4,727,720 | A | 3/1988 | Wernicki | |
| 4,843,827 | A | 7/1989 | Peppers | |
| 4,852,359 | A | 8/1989 | Manzotti | |
| 4,856,463 | A | 8/1989 | Johnston | |
| 5,025,756 | A | 6/1991 | Nyc | |
| 5,044,600 | A | 9/1991 | Shannon | |
| 5,129,237 | A | 7/1992 | Day et al. | |
| 5,157,929 | A | 10/1992 | Hotaling | |
| 5,177,980 | A | 1/1993 | Kawamoto et al. | |
| 5,196,127 | A | 3/1993 | Solell | |
| 5,257,601 | A | 11/1993 | Coffin | |
| 5,408,844 | A | 4/1995 | Stokes | |
| 5,425,243 | A | 6/1995 | Sanuki et al. | |
| 5,483,929 | A | 1/1996 | Kuhn et al. | |
| 5,586,439 | A | 12/1996 | Schlosser et al. | |
| 5,884,490 | A | 3/1999 | Whidden | |
| 6,101,817 | A | 8/2000 | Watt | |
| 6,148,621 | A | 11/2000 | Byczynski et al. | |
| 6,179,045 | B1 | 1/2001 | Lilleaas | |
| 6,209,849 | B1 | 4/2001 | Dickmeyer | |
| 6,282,909 | B1 | 9/2001 | Newman et al. | |
| 6,357,720 | B1 | 3/2002 | Shapiro et al. | |
| 6,647,739 | B1 | 11/2003 | Kim et al. | |
| 6,688,130 | B1 | 2/2004 | Kim | |
| 6,688,131 | B1 | 2/2004 | Kim et al. | |
| 6,735,959 | B1 | 5/2004 | Najewicz | |
| 6,742,351 | B2 | 6/2004 | Kim et al. | |
| 6,782,706 | B2 | 8/2004 | Holmes et al. | |
| 6,857,277 | B2 | 2/2005 | Somura | |
| 6,935,124 | B2 | 8/2005 | Takahashi et al. | |
| 6,951,113 | B1 | 10/2005 | Adamski | |
| 7,010,934 | B2 | 3/2006 | Choi et al. | |
| 7,013,654 | B2 | 3/2006 | Tremblay et al. | |
| 7,062,936 | B2 | 6/2006 | Rand et al. | |
| 7,082,782 | B2 | 8/2006 | Schlosser et al. | |
| 7,188,479 | B2 | 3/2007 | Anselmino et al. | |
| 7,201,014 | B2 | 4/2007 | Hornung | |
| 7,204,092 | B2 | 4/2007 | Azcárate Castrellón et al. | |
| 7,216,491 | B2 | 5/2007 | Cole et al. | |
| 7,234,423 | B2 | 6/2007 | Lindsay | |
| 7,318,323 | B2 | 1/2008 | Tatsui et al. | |
| 7,386,993 | B2 | 6/2008 | Castrellón et al. | |
| 7,568,359 | B2 | 8/2009 | Wetekamp et al. | |
| 7,587,905 | B2 | 9/2009 | Kopf | |
| 7,681,406 | B2 | 3/2010 | Cushman et al. | |
| 7,703,292 | B2 | 4/2010 | Cook et al. | |
| 7,866,167 | B2 | 1/2011 | Kopf | |
| 8,037,697 | B2 | 10/2011 | LeClear et al. | |
| 8,117,863 | B2 | 2/2012 | Van Meter et al. | |
| 2002/0014087 | A1 | 2/2002 | Kwon | |
| 2003/0111028 | A1 | 6/2003 | Hallenstvedt | |
| 2004/0261427 | A1 | 12/2004 | Tsuchikawa et al. | |
| 2005/0126185 | A1 | 6/2005 | Joshi | |
| 2006/0016209 | A1 | 1/2006 | Cole et al. | |
| 2006/0150645 | A1 | 7/2006 | Leaver | |
| 2006/0168983 | A1 | 8/2006 | Tatsui et al. | |
| 2006/0242971 | A1* | 11/2006 | Cole | 62/66 |
| 2007/0028866 | A1 | 2/2007 | Lindsay | |
| 2007/0107447 | A1* | 5/2007 | Langlotz | 62/66 |
| 2007/0137241 | A1 | 6/2007 | Lee et al. | |
| 2007/0227162 | A1 | 10/2007 | Wang | |
| 2008/0104991 | A1 | 5/2008 | Hoehne et al. | |
| 2009/0049858 | A1 | 2/2009 | Lee et al. | |
| 2009/0165492 | A1 | 7/2009 | Wilson et al. | |
| 2009/0178430 | A1 | 7/2009 | Jendrusch et al. | |
| 2009/0187280 | A1 | 7/2009 | Hsu et al. | |
| 2009/0211266 | A1 | 8/2009 | Kim et al. | |
| 2009/0211271 | A1 | 8/2009 | Kim et al. | |
| 2009/0223230 | A1 | 9/2009 | Kim et al. | |
| 2009/0235674 | A1 | 9/2009 | Kern et al. | |
| 2009/0272259 | A1 | 11/2009 | Cook et al. | |
| 2009/0308085 | A1 | 12/2009 | DeVos | |
| 2010/0018226 | A1 | 1/2010 | Kim et al. | |
| 2010/0031675 | A1 | 2/2010 | Kim et al. | |
| 2010/0050663 | A1 | 3/2010 | Venkatakrishnan et al. | |
| 2010/0050680 | A1 | 3/2010 | Venkatakrishnan et al. | |
| 2010/0095692 | A1 | 4/2010 | Jendrusch et al. | |
| 2010/0101254 | A1 | 4/2010 | Besore et al. | |
| 2010/0126185 | A1 | 5/2010 | Cho et al. | |
| 2010/0139295 | A1 | 6/2010 | Zuccolo et al. | |
| 2010/0180608 | A1 | 7/2010 | Shaha et al. | |
| 2010/0257888 | A1 | 10/2010 | Kang et al. | |
| 2010/0319367 | A1* | 12/2010 | Kim et al. | 62/71 |
| 2010/0326093 | A1 | 12/2010 | Watson et al. | |
| 2011/0062308 | A1 | 3/2011 | Hammond et al. | |
| 2011/0146312 | A1 | 6/2011 | Hong et al. | |
| 2011/0192175 | A1 | 8/2011 | Kuratani et al. | |
| 2011/0214447 | A1 | 9/2011 | Bortoletto et al. | |
| 2011/0265498 | A1 | 11/2011 | Hall | |
| 2012/0023996 | A1 | 2/2012 | Herrera et al. | |
| 2012/0073538 | A1 | 3/2012 | Hofbauer | |
| 2012/0085302 | A1 | 4/2012 | Cleeves | |
| 2012/0174613 | A1 | 7/2012 | Park et al. | |
| 2012/0240613 | A1 | 9/2012 | Saito et al. | |
| 2013/0276468 | A1 | 10/2013 | Buehrle et al. | |

FOREIGN PATENT DOCUMENTS

| | | | |
|---|---|---|---|
| JP | 2000039240 | A | 2/2000 |
| JP | 2001041620 | A | 2/2001 |
| JP | 2001041624 | A | 2/2001 |
| JP | 2002139268 | | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2004053036 | A | 2/2004 |
| JP | 2004278894 | A | 10/2004 |
| JP | 2004278990 | A | 10/2004 |
| JP | 2005164145 | | 6/2005 |
| JP | 2005195315 | | 7/2005 |
| JP | 2006022980 | A | 1/2006 |
| JP | 2006323704 | A | 11/2006 |
| KR | 2006013721 | A | 2/2006 |
| WO | 2008052736 | A1 | 5/2008 |
| WO | 2008061179 | A2 | 5/2008 |

OTHER PUBLICATIONS

Merriam-Webster definition of oscillate, http://www.Merriam-Webster.com/dictionary/oscillate, 4 pages, accessed from internet Aug. 6, 2015.

European Search Report, Application No. 2784416, dated Mar. 10, 2015, 7 pages.

European Search Report, Application No. 13194679.0, Nov. 7, 2016, 10 pages.

* cited by examiner

WEIRLESS ICE TRAY

BACKGROUND OF THE INVENTION

Various types of trays have been developed for forming ice cubes. Known trays may include a plurality of cavities that receive liquid water prior to freezing, and may also include weirs extending between the cavities. The weirs provide for flow of water from a cavity to adjacent cavities as the cavities are filled with liquid water. However, known ice forming trays may suffer from various drawbacks.

SUMMARY OF THE INVENTION

One aspect of the present invention is an ice making system including a weirless ice tray having upper and lower sides. The ice tray includes a body portion and a plurality of upwardly opening cavities that are interconnected by the body portion. Each cavity has an upper peripheral edge defining an opening for receiving liquid water to be frozen in the cavity. Each cavity defines a cavity volume whereby liquid water in excess of the cavity volume overflows the cavity if excess water is introduced into the cavity. The upper peripheral edges do not form weirs between adjacent cavities such that excess water overflowing a cavity does not flow solely into adjacent cavities. The ice making system further includes a water distribution system configured to introduce a volume of water into each cavity that is no greater than each cavity volume to thereby substantially fill each cavity with liquid water without overflowing the cavities. The water distribution system may include a fluid conduit having a plurality of outlets, with at least one outlet being positioned above each cavity such that water flowing through the fluid conduit exits the outlets and flows into the cavities. The fluid conduit may comprise a primary fluid conduit and a plurality of individual fluid conduits extending from the primary fluid conduit to the outlets. The fluid conduit may comprise an upwardly opening trough forming the outlets, the fluid conduit further comprising an elongated tubular member that is fluidly connected to the trough to supply water to the trough. The ice tray may be made from a thin sheet of metal such as aluminum or stainless steel. The ice tray may also be made from a polymer material.

These and other features, advantages, and objects of the present invention will be further understood and appreciated by those skilled in the art by reference to the following specification, claims, and appended drawings.

DETAILED DESCRIPTION

Figure 2:
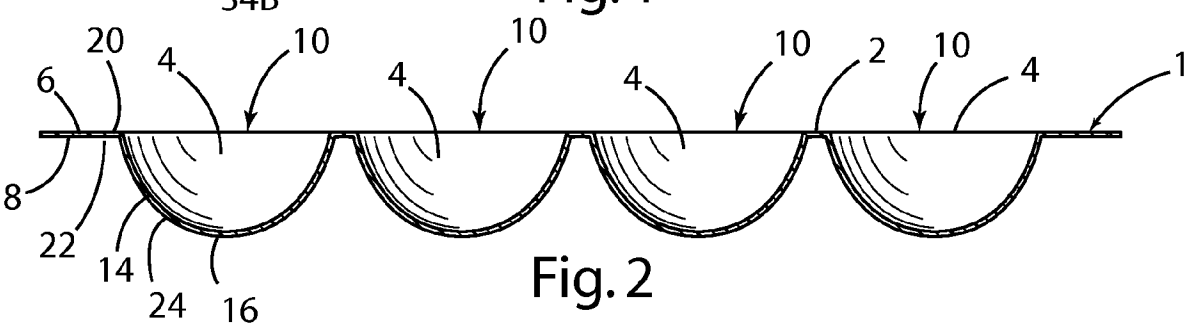
FIG. 2 is a cross sectional view of the ice tray of FIG. 1 taken along the II-II.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
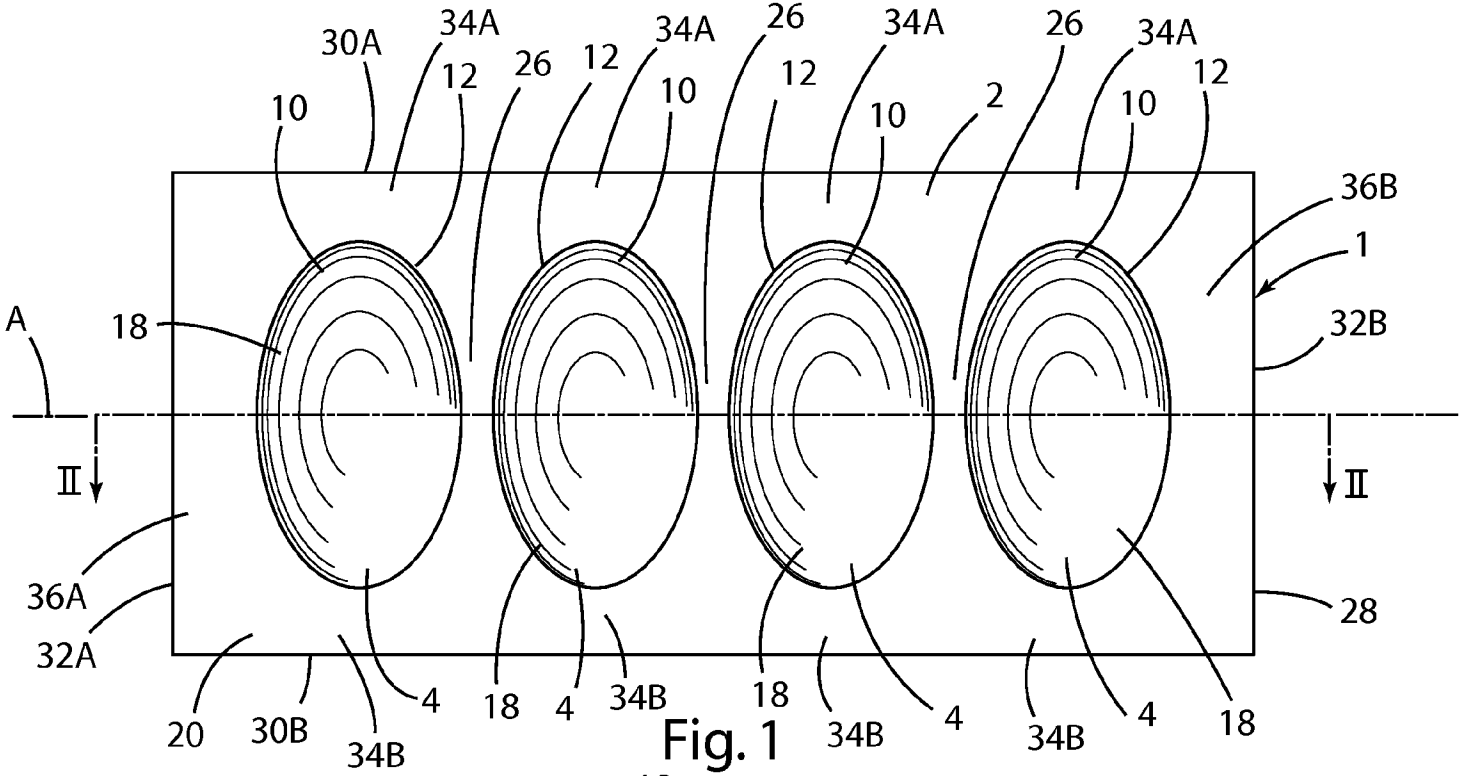
FIG. 1 is a plan view of an ice tray according to one aspect of the present disclosure.

With reference to FIGS. 1 and 2, an ice tray 1 according to one aspect of the present invention includes a body portion 2, and a plurality of upwardly opening cavities 4. The body portion 2 and cavities 4 are preferably formed from a single piece of sheet metal such as stainless steel, aluminum, or other suitable metal. For example, the ice tray 1 may be formed from stainless steel having a thickness of about 0.035 inches to about 0.065 inches. The ice tray 1 may be formed from a flat sheet of metal utilizing known die forming processes or other suitable techniques. The ice tray 1 may also be made from a single piece of molded polymer or other suitable material utilizing a mold or other known processes.

The body portion 2 generally comprises a thin sheet of material having an upper side 6 and a lower side 8. Cavities 4 include openings 10 that are defined by edges 12. Cavities 4 are generally formed by upwardly extending sidewalls 14, and a lower wall 16. The sidewalls 14 and lower wall 16 may be curved, and may blend together, such that the terms "sidewall" and "lower wall" do not necessarily refer to vertical and horizontal walls. The sidewalls 14 and lower walls 16 form a concave inner surfaces 18 defining cavities 4. The sidewalls 14 intersect the body portion 2 at an angle of about 90° to define edges 12 extending around cavities 4 to define openings 10. Edges 12 may have a radius such that the transition from the body portion 2 to the sidewalls 14 does not form a sharp corner. For example, inner surface 18 of sidewall 14 may transition to upper surface 20 of body portion 2 to define an outer radius of about 0.050-0.100 inches.

The body portion 2 defines a generally quadrilateral perimeter 28 (FIG. 1) having elongated opposite edges 30A and 30B, and end edges 32A and 32B. The body portion 2 includes regions 26 between adjacent cavities 4, and regions 34A between cavities 4 and elongated edge 30A, and regions 34B between cavities 4 and elongated edges 30B. Still further, body portion 2 also includes regions 36A and 36B that extend between the outermost cavities 4 and end edges 32A and 32B, respectively. The regions 26, 34, 36, 36A and 36B are generally planar. As discussed in more detail below, in use, ice tray 1 may be twisted about an elongated axis "A" (FIG. 1) to assist in removing ice cubes from cavities 4. Because the body portion 2 is substantially planar, stress increases that otherwise could occur in the vicinity of channels or weirs extending between cavities 4 is reduced.

The reduced stress helps extend the life of ice tray 1.

Figure 3:
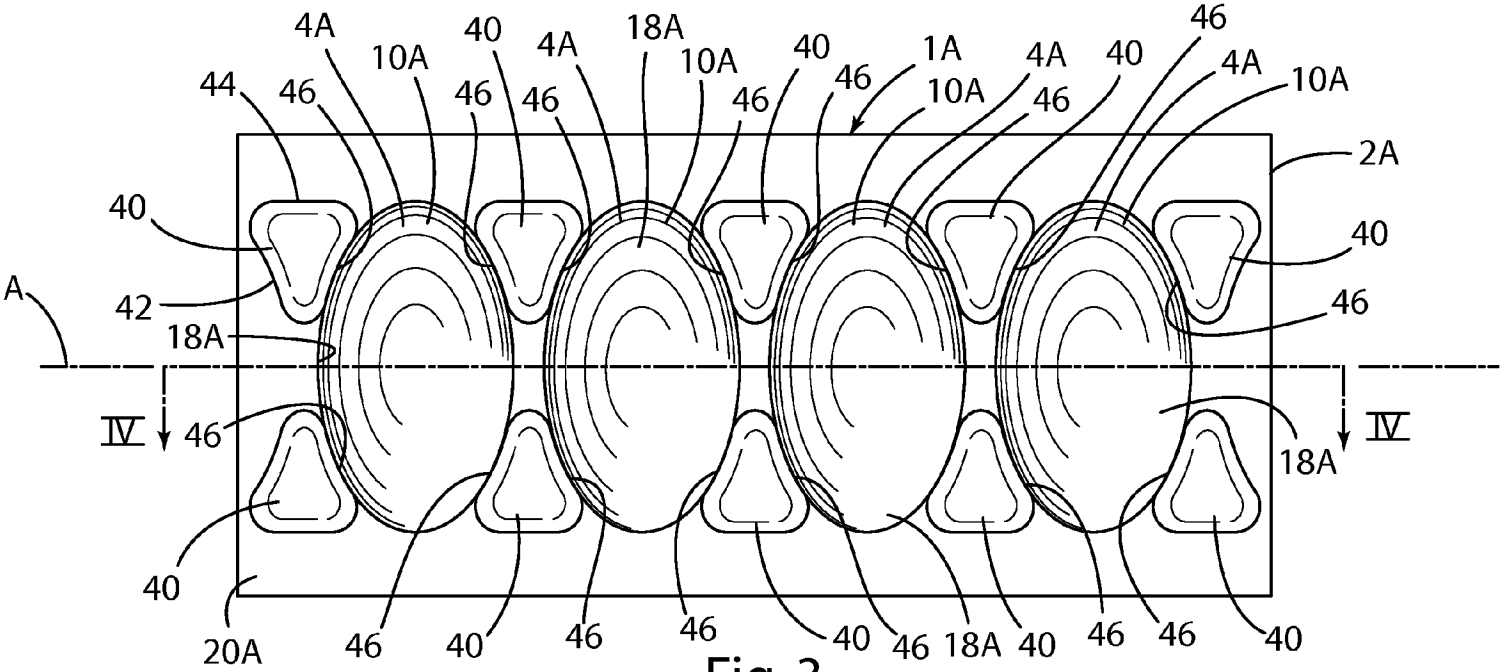
FIG. 3 is a plan view of an ice tray according to another aspect of the present disclosure.
Figure 4:
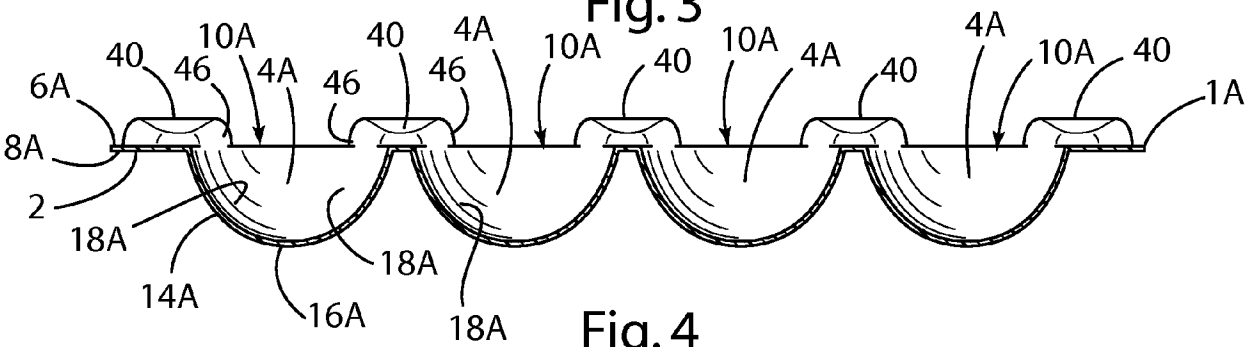
FIG. 4 is a cross sectional view of the ice tray of FIG. 3 taken along the line IV-IV.

With further reference to FIGS. 3 and 4, an ice tray 1A according to another aspect of the present disclosure includes a body portion 2A and a plurality of cavities 4A. In contrast to ice tray 1 of FIGS. 1 and 2, ice tray 1A includes a plurality of raised portions 40 that are generally triangular in plan view (FIG. 3). Sidewalls 42 and 44 of raised portions 40 extend transversely upward from upper surface 20A of body portion 2A. Inner sidewalls 46 of raised portions 40 generally face cavities 4, and extend continuously upwardly from inner surfaces 18A of cavities 4A.

As discussed above in connection with FIGS. 1 and 2, ice tray 1 is twisted to remove ice cubes from cavities 4. Because the body portion 2 (FIGS. 1 and 2) of ice tray 1 is generally flat, it is relatively flexible with respect to twisting about axis A. However, the sidewalls 14 stiffen the body portion 2 in the areas directly adjacent edges 12. This stiffness may cause increased stress in the body portion 2 in the regions directly adjacent edges 12. Furthermore, although the edges 12 may be radiused at the transition between body portion 2 and sidewalls 14, the geometry of the edges 12 also tends to cause increased stress at the edges 12. Still further, the cavities 4 are relatively rigid with respect to twisting of ice tray 1 about axis A, such that a significant portion of the deformation and resulting stress from twisting of ice tray 1 tends to occur in the regions 26 of body portion 2 between cavities 4.

Referring again to FIGS. 3 and 4, the regions of body portion 2 where the highest stress concentrations tend to occur correspond to the raised portions 40. The geometry of the raised portions 40 reduces the stress concentrations in these regions to thereby extend the life of ice tray 1A. It will be understood that the shape, size, and location of the raised portions 40 may vary somewhat depending upon the geometry of the cavities 4, the material selected to form ice tray 1, the degree of flexing required to release ice cubes from cavities 4, and other such factors.

Figure 5:
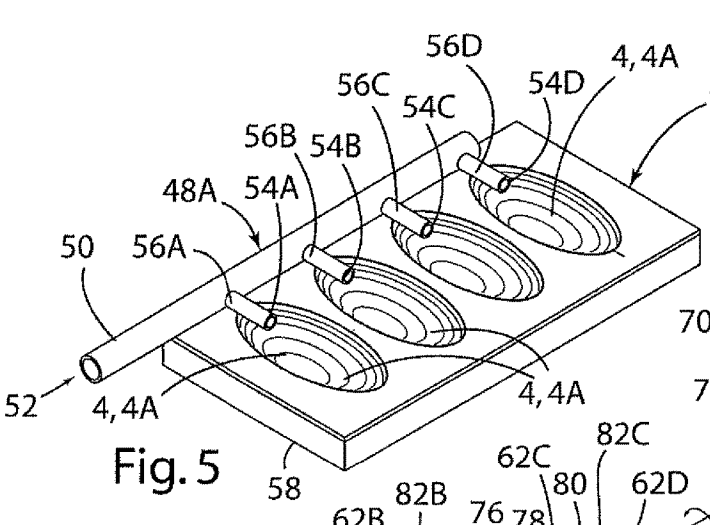
FIG. 5 is an isometric view of an ice tray and water supply arrangement according to another aspect of the present disclosure.

As discussed above, the ice trays 1 and 1A do not include weirs to distribute water from adjacent cavities 4 or 4A, respectively. With further reference to FIG. 5, a water distribution system 48A includes a fluid conduit 50 that receives water from an external source, and distributes water 52 to a plurality of openings 54A-54D that are fluidly connected to individual conduits 56A-560, respectively. The fluid distribution system 50A provides a predefined volume of water to each cavity 4 or 4A. The volume of water is the same or less than the volume of each cavity 4 or 4A to thereby prevent overflow of the cavities. The tray 1 or 1A may be supported by a support member 58 to thereby position the tray 1 or 1A relative to the openings 54A-54D. The openings 54A-54D are preferably directly above the cavities 4 or 4A, such that water exiting the openings 54A-54D flows directly into the cavities 4 or 4A.

Figure 6:
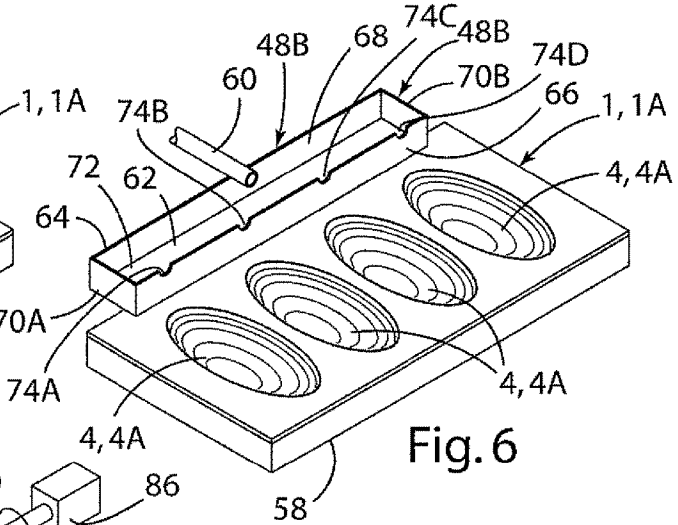
FIG. 6 is an isometric view of an ice tray and water supply arrangement according to another aspect of the present disclosure.

With further reference to FIG. 6, a water distribution system 48B according to another aspect of the present invention includes a fluid supply conduit 60 having an opening 60 that is positioned directly above a cavity 62 of a trough 64. Trough 64 includes a front wall 66, a rear wall 68, and end walls 70A and 70B. A bottom wall 72 extends between the walls 66, 68, 70A and 70B to thereby define cavity 62. However, the trough 64 could have other shapes (e.g. curved side and bottom walls). A plurality of openings 74A-74D in the form of indentations or cut outs in front wall 66 provide for flow of water from cavity 62 of trough 64 into the cavities 4 or 4A of ice tray 1 or 1A, respectively. It will be understood that the openings 74A-74D could comprise apertures or other suitable fluid passageways through front wall 66 of trough 64.

Figure 7:
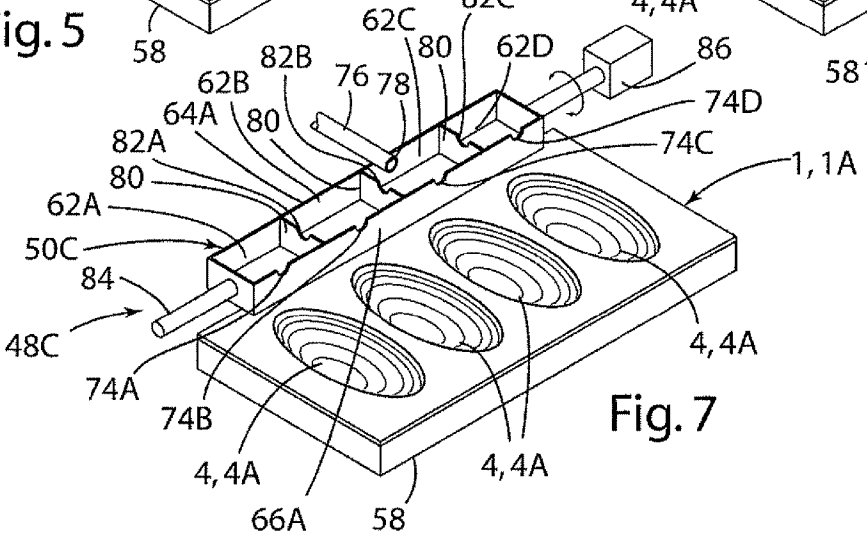
FIG. 7 is an isometric view of an ice tray and water supply arrangement according to another aspect of the present disclosure.

With further reference to FIG. 7, a trough 64A may include a plurality of divider walls 80 forming a plurality of individual cavities 62A-62D. The partition walls 80 include cutouts 82A-82C that permits flow of water between the individual cavities 62A-62D. A shaft 84 rotatably supports the trough 64A, and a powered actuator such as an electric motor 86 provides for powered rotation of trough 64A. In use, water flows through conduit 76, and exits opening 78 of conduit 76 and flows into a selected one of the individual cavities 62A-62D. The water then flows to adjacent cavities through cutouts 82 in divider walls 80. Once a specified amount of water has been introduced into the cavities 62A-62D, electric motor 86 rotates such that the water pours through openings 74A-74D in front wall 66A of trough 64A.

Figure 8:
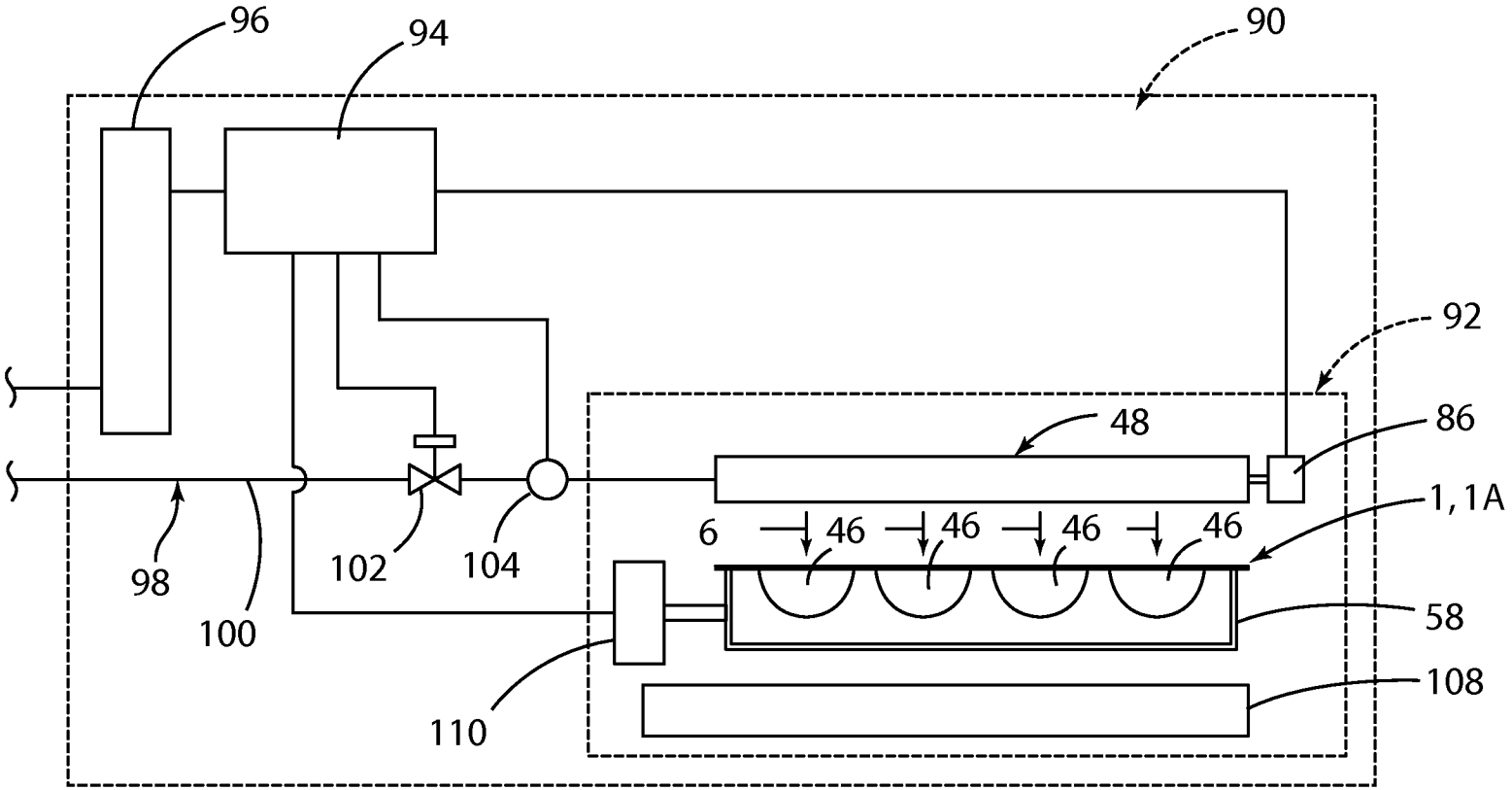
FIG. 8 is a schematic view of a freezer including an ice tray, water supply system, and ice cube storage bin according to another aspect of the present disclosure.

With reference to FIG. 8, a refrigerator 90 may include a freezer compartment 92, a controller 94, and a cooling system 96 that is operably connected to the controller 94. Water distribution system 98 includes a water supply conduit 100, a powered valve 102, and a pump 104. The valve 102 and pump 104 are operably connected to controller 94, and controller 94 thereby controls the amount of water that is supplied to a water distribution system 48. The flow rate of water through water distribution system 48 may be determined by testing, and the valve 102 and/or pump 104 may be actuated for a specific time interval to permit a predefined volume of water to be introduced into each cavity 4 or 4A. It will be understood that the water distribution system 48 may comprise a water distribution system as disclosed in FIG. 5, FIG. 6, or FIG. 7, or it may comprise another suitable water distribution system.

The ice tray 1 or 1A is positioned in a support 58 in a freezer compartment 92 above an ice storage bin 108. After a predetermined amount of water 6 is introduced into each cavity 4 (or 4A), the water freezes to form ice cubes. A device 110 is configured to twist ice tray 1 or 1A to break the ice cubes free, and to rotate ice tray 1 or 1A such that the ice cubes fall into ice storage bin 108 positioned directly below the ice tray 1 or 1A. Device 110 then rotates the ice tray 1 or 1A back to an upright position with cavities 4 or 4A facing upwardly to receive water 6 from water distribution system 48. Device 110 is operably connected to controller 94. Device 110 may be substantially similar to known ice harvesting devices that twist and rotate ice cube trays for harvest of the ice cubes, and device 110 will therefore not be described in detail herein. It will be understood that ice tray 1 or 1A may also be manually twisted/deformed and rotated by a user to thereby remove ice cubes.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. An ice making system, comprising:

a weirless ice tray having upper and lower sides, the tray including a body portion and a plurality of upwardly opening cavities that are interconnected by the body portion, each cavity having an upper peripheral edge defining an opening for receiving liquid water to be frozen in the cavity, each cavity defining a cavity volume whereby liquid water in excess of the cavity volume overflows the cavity if introduced into the cavity, wherein the upper peripheral edges do not form weirs between adjacent cavities such that excess liquid water overflowing a cavity does not flow solely into adjacent cavities;

a water distribution system configured to introduce a volume of water into each cavity that is no greater than each cavity volume to thereby substantially fill each cavity with liquid water without overflowing the cavities.

2. An ice making system, comprising:

a weirless ice tray having upper and lower sides, the tray including a body portion and a plurality of upwardly opening cavities that are interconnected by the body portion, each cavity having an upper peripheral edge defining an opening for receiving liquid water to be frozen in the cavity, each cavity defining a cavity volume whereby liquid water in excess of the cavity volume overflows the cavity if introduced into the cavity, wherein the upper peripheral edges do not form weirs between adjacent cavities such that excess liquid water overflowing a cavity does not flow solely into adjacent cavities;

a water distribution system configured to introduce a volume of water into each cavity that is no greater than each cavity volume to thereby substantially fill each cavity with liquid water without overflowing the cavities; and wherein:

the water distribution system includes a fluid conduit having a plurality of outlets, at least one outlet being positioned above each cavity such that water flowing through the fluid conduit exits the outlets and flows into the cavities.

3. The ice making system of claim 2, wherein:

the fluid conduit comprises a primary fluid conduit and a plurality of individual conduits extending from the primary fluid conduit to the outlets.

4. The ice making system of claim 3, wherein:

the cavities form a row of cavities; and the primary fluid conduit comprises an elongated tubular member extending along the row of cavities.

5. The ice making system of claim 2, wherein:

the fluid conduit comprises an upwardly opening trough forming the outlets; and the fluid conduit further comprises an elongated tubular member that is fluidly connected to the trough to supply water to the trough.

6. The ice making system of claim 5, wherein:

the trough comprises elongated generally upright front and rear sidewalks and a lower wall extending between the front and rear sidewalls; and the outlets comprise fluid passageways through the front wall of the trough.

7. The ice making system of claim 1, wherein:

the water distribution system includes a flow control device;

the ice making system includes a controller that is operably connected to the flow control device, wherein the controller actuates the flow control device to introduce a volume of water into each cavity that is no greater than the cavity volumes.

8. The ice making system of claim 7, wherein:

the flow control device comprises a valve having a powered actuator.

9. The ice making system of claim 7, wherein:

the flow control device comprises an electrically powered pump.

10. The ice making system of claim 1, wherein:

the body portion comprises a thin sheet of material having substantially planar upper surface portions.

11. The ice making system of claim 10, wherein:

the entire body portion comprises a single planar sheet of metal with a continuous planar upper surface that is free of protrusions.

12. An ice making system, comprising:

a weirless ice tray having upper and lower sides, the tray including a body portion and a plurality of upwardly opening cavities that are interconnected by the body portion, each cavity having an upper peripheral edge defining an opening for receiving liquid water to be frozen in the cavity, each cavity defining a cavity volume whereby liquid water in excess of the cavity volume overflows the cavity if introduced into the cavity, wherein the upper peripheral edges do not form weirs between adjacent cavities such that excess liquid water overflowing a cavity does not flow solely into adjacent cavities;

a water distribution system configured to introduce a volume of water into each cavity that is no greater than each cavity volume to thereby substantially fill each cavity with liquid water without overflowing the cavities;

the body portion comprises a thin sheet of material having substantiallvplanar upper surface portions; and wherein:

the body portion comprises formed sheet metal having upwardly-protruding raised portions disposed between adjacent cavities.

13. The ice making system of claim 1, wherein:

the ice making system includes an ice storage bin and a powered device that twists and rotates the ice tray to thereby cause ice cubes in the tray to become dislodged and fall into the ice storage bin.

14. The method of claim 1, wherein:

the openings are oblong.

15. The method of claim 14, wherein:

the openings are approximately oval in shape in plan view.

16. The method of claim 1, wherein:

all of the cavity volumes are equal to one another.

17. A method of making ice cubes, the method comprising:

providing an ice tray having a plurality of upwardly opening cavities, each cavity defining a cavity volume such that the cavities overflow if a volume of water greater than the cavity volume is introduced into the cavities;

introducing a volume of water into each cavity, wherein the volumes of water are no greater than the cavity volumes such that the cavities do not overflow; and freezing the water in the cavities to form ice cubes.

18. The method of claim 17, including:

removing ice cubes from the ice tray by twisting the ice tray and rotating the ice tray such that the ice cubes fall out of the cavities.

19. The method of claim 17, wherein:

the volumes of water are equal to one another.

20. A method of making ice cubes, the method comprising:

providing an ice tray having a plurality of upwardly opening cavities, each cavity defining a cavity volume such that the cavities overflow if a volume of water greater than the cavity volume is introduced into the cavities;

introducing a volume of water into each cavity, wherein the volumes of water are no greater than the cavity volumes such that the cavities do not overflow;

freezing the water in the cavities to form ice cubes; and wherein:

the volumes of water are introduced by utilizing a fluid conduit having a fluid exit positioned above each cavity.

* * * * *